US010727589B2

(12) United States Patent
Ikeda et al.

(10) Patent No.: US 10,727,589 B2
(45) Date of Patent: Jul. 28, 2020

(54) ANTENNA DEVICE

(71) Applicant: DENSO CORPORATION, Kariya, Aichi-pref. (JP)

(72) Inventors: Masakazu Ikeda, Nishio (JP); Hiroaki Kuraoka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 101 days.

(21) Appl. No.: 15/322,184

(22) PCT Filed: Jun. 23, 2015

(86) PCT No.: PCT/JP2015/003126
§ 371 (c)(1),
(2) Date: Dec. 27, 2016

(87) PCT Pub. No.: WO2016/002162
PCT Pub. Date: Jan. 7, 2016

(65) Prior Publication Data

US 2017/0149137 A1 May 25, 2017

(30) Foreign Application Priority Data

Jul. 3, 2014 (JP) ..... 2014-137870

(51) Int. Cl.
*H01Q 5/328* (2015.01)
*H01Q 9/04* (2006.01)
(Continued)

(52) U.S. Cl.
CPC ..... *H01Q 5/328* (2015.01); *H01Q 1/2291* (2013.01); *H01Q 1/32* (2013.01); *H01Q 1/36* (2013.01);
(Continued)

(58) Field of Classification Search
CPC ..... H01Q 1/3275; H01Q 1/3283; H01Q 1/12; H01Q 1/1207; H01Q 1/125; H01Q 9/0407;
(Continued)

(56) References Cited

U.S. PATENT DOCUMENTS 7,046,196 B1 5/2006 Langley et al.
2002/0036625 A1 3/2002 Nakamura
(Continued)

FOREIGN PATENT DOCUMENTS

JP S56141604 A 11/1981
JP S56141605 A 11/1981
(Continued)

OTHER PUBLICATIONS

Kin-Lu Wong et al., "Compact Miscrostrip Antenna with Dual-Frequency Operation", Electronics Letters, vol. 33 No. 8, The Institution of Engineering and Technology, Apr. 10, 1997, pp. 646-647.

*Primary Examiner* — Ricardo I Magallanes
(74) *Attorney, Agent, or Firm* — Harness, Dickey & Pierce, P.L.C.

(57) ABSTRACT

An antenna device includes a rectangular conductor pattern that is disposed substantially in parallel to a ground plate at a predetermined distance, a short-circuit portion that electrically connects the conductor pattern to the ground plate, a first feeding point for transmitting and receiving a signal of a first frequency, and a second feeding point for transmitting and receiving a signal of a second frequency. An electric length of one side of the conductor pattern is set to half a wavelength of the second frequency. The short-circuit portion is disposed in the center portion of the conductor pattern, and an area of the conductor pattern forms a
(Continued)

ELECTRIC FIELD DISTRIBUTION AND CURRENT, VOLTAGE DISTRIBUTIONS FOR RADIO WAVES OF FIRST FREQUENCY capacitance that resonates in parallel with an inductance provided in the short-circuit portion at the first frequency.

12 Claims, 6 Drawing Sheets

(51) Int. Cl.

| | |
|---|---|
| ***H01Q 5/35*** | (2015.01) |
| ***H01Q 5/335*** | (2015.01) |
| ***H01Q 5/378*** | (2015.01) |
| ***H01Q 1/22*** | (2006.01) |
| ***H01Q 1/32*** | (2006.01) |
| ***H01Q 1/36*** | (2006.01) |
| ***H01Q 1/48*** | (2006.01) |

(52) U.S. Cl.
CPC ..... *H01Q 1/48* (2013.01); *H01Q 5/335* (2015.01); *H01Q 5/35* (2015.01); *H01Q 5/378* (2015.01); *H01Q 9/0407* (2013.01); *H01Q 9/0421* (2013.01); *H01Q 9/0435* (2013.01); *H01Q 9/0442* (2013.01)

(58) Field of Classification Search
CPC .... H01Q 9/045; H01Q 9/0442; H01Q 9/0435; H01Q 5/35
USPC ..... 343/711, 878, 713, 720
See application file for complete search history.

(56) References Cited

U.S. PATENT DOCUMENTS

| | | | | |
|---|---|---|---|---|
| 2002/0075211 | A1 | 6/2002 | Nakamura | |
| 2012/0176208 | A1* | 7/2012 | Shirakawa | H01P 5/184 333/24 R |
| 2012/0299778 | A1* | 11/2012 | Yen | H01L 23/48 343/700 MS |
| 2013/0314297 | A1* | 11/2013 | Hamabe | H01Q 21/28 343/893 |
| 2014/0320376 | A1* | 10/2014 | Ozdemir | H01Q 9/0442 343/876 |
| 2014/0375506 | A1* | 12/2014 | Ko | H01Q 1/243 343/700 MS |
| 2016/0365622 | A1* | 12/2016 | Na | H01Q 9/42 |
| 2019/0036220 | A1* | 1/2019 | Paulotto | H01Q 1/243 |
| 2019/0103676 | A1* | 4/2019 | Sugimoto | H01Q 9/0407 |

FOREIGN PATENT DOCUMENTS

| | | | |
|---|---|---|---|
| JP | H10145133 | A | 5/1998 |
| JP | H11041026 | A | 2/1999 |
| JP | 2003347838 | A | 12/2003 |
| JP | 200502030 | A | 1/2005 |

* cited by examiner

ELECTRIC FIELD DISTRIBUTION AND CURRENT,
VOLTAGE DISTRIBUTIONS FOR RADIO WAVES OF SECOND FREQUENCY

ELECTRIC FIELD DISTRIBUTION AND CURRENT, VOLTAGE DISTRIBUTIONS FOR RADIO WAVES OF FIRST FREQUENCY

ANTENNA DEVICE

CROSS-REFERENCE TO RELATED APPLICATIONS

This application is a U.S. National Phase Application under 35 U.S.C. 371 of International Application No. PCT/JP2015/003126 filed on Jun. 23, 2015 and published in Japanese as WO 2016/002162 A1 on Jan. 7, 2016. This application is based on and claims the benefit of priority from Japanese patent application No. 2014-137870 filed on Jul. 3. The entire disclosures of all of the above applications are incorporated herein by reference.

TECHNICAL FIELD

The present disclosure relates to an antenna device that receives radio waves broadcast from a satellite and radio waves broadcast from an equipment placed on earth.

BACKGROUND ART

Up to now, an antenna device used in a moving object such as a vehicle for receiving both of radio waves broadcast from a satellite and arriving from a zenith direction, and radio waves broadcast from an equipment placed on earth and arriving from a horizontal direction is disclosed in Patent Literature 1.

The antenna device disclosed in Patent Literature 1 has a well-known patch antenna and a well-known monopole antenna integrated together. The antenna device includes a linear antenna element disposed perpendicular to a plane on which the patch antenna is formed. The linear antenna serves as the monopole antenna. With the use of the antenna device in a posture where the plane of the patch antenna is horizontal, the radio waves from the zenith direction are received by the patch antenna and the radio waves from the horizontal direction are received by the monopole antenna.

PRIOR PATENT LITERATURE

Patent Literature

Patent Literature 1: JP 2003-347838 A

Summary of Invention

In the antenna device disclosed in Patent Literature 1, because two antenna elements of the patch antenna and the monopole antenna are required, the respective antenna elements may be costly. Further, because the monopole antenna intended for the radio waves from the horizontal direction requires a length of a quarter wavelength of the radio waves intended for transmission and reception, a height (a mounting height) of the antenna device is likely to be higher. The mounting height represents a height of the antenna device that is mounted on a moving object in a posture where the plane of the patch antenna is horizontal.

The present disclosure has been made under the above circumstances, and an object of the present disclosure is to provide an antenna device that is capable of receiving radio waves from a zenith direction and a horizontal direction and capable of suppressing a mounting height and a manufacturing cost. According to a first aspect of the present disclosure, there is provided a ground plate, a plate-shaped conductor pattern disposed in parallel to the ground plate at a predetermined distance from the ground plate, a short-circuit portion that electrically connects the conductor pattern to the ground plate, and at least one feeding point that electrically connects the conductor pattern to a feeding line for feeding a power to the conductor pattern, where a planar shape of the conductor pattern is based on an axisymmetrical shape being symmetrical about a symmetrical axis that is a straight line parallel to a first direction and a second direction which are orthogonal to each other, the short-circuit portion is disposed in a center portion of the conductor pattern, an area of the conductor pattern forms a capacitance that resonates in parallel with an inductance included in the short-circuit portion at a first frequency, and an electric length of the conductor pattern in the second direction is half of a wavelength of the second frequency, the second frequency being higher than the first frequency.

Hereinafter, the operation and advantages of the antenna device will be described. Because the antenna device has the reversibility of transmission and reception, the configuration of the antenna device in a case of receiving the radio waves will be described.

Because an electric length of a conductor pattern in a second direction is half a wavelength of a second frequency, in a configuration having no short-circuit portion, the antenna device performs the same operation as that of a known patch antenna (also called "micro-strip antenna") for the radio waves of the second frequency. In other words, the antenna device is configured to have a directivity in a direction perpendicular to the plane of the conductor pattern.

In the patch antenna, an amplitude of a voltage standing wave and an electric field intensity are zero in the center portion of a side having a length that is half the wavelength of the radio waves to be received. For that reason, even if the short-circuit portion is provided in the center portion of the conductor pattern, a radiation characteristic is not affected.

In other words, according to the present disclosure, with the horizontal placement of the conductor pattern, the antenna device has the directivity in a vertical direction for the radio waves of the second frequency, and can receive the radio waves of the second frequency arriving from the vertical direction. When the antenna device is placed in a substantially horizontal location, the antenna device can receive the radio waves of the second frequency arriving from the zenith direction.

In addition, the conductor pattern has an area forming a capacitance that resonates in parallel with an inductance provided in the short-circuit portion at the first frequency. For that reason, when the radio wave of the first frequency arrives at the conductor pattern, voltage standing waves and current standing waves of the first frequency are generated on the conductor pattern. In this example, because the conductor pattern is of an axisymmetrical structure, and the short-circuit portion is disposed in the center portion of the conductor pattern, the current standing wave is symmetrical with respect to the short-circuit portion. For that reason, the radiation in the zenith direction caused by the current and the radio waves of horizontally polarized waves in the horizontal direction cancel each other, and do not contribute to the radiation.

On the other hand, since the short-circuit portion is disposed in the center portion of the conductor pattern, the amplitude of the voltage standing wave becomes zero in the center portion of the conductor pattern, and maximum at an end portion of the conductor pattern, and a sign of the voltage is the same as that in the vertical direction even in any region. Because a direction and an intensity of an electric field developed between a ground plate and the conductor pattern are in proportion to a distribution of the voltage, the electric field is in the same direction (for example, a direction from the ground plate to the conductor pattern) in any region. The intensity is greater toward the end portions from the center portion and is radiated as vertically polarized waves at the ends. For that reason, with respect to the first frequency, the antenna device has the directivity of the vertically polarized waves in a direction from the center portion of the conductor pattern toward the end portions, that is, in the horizontal direction.

In other words, according to the above configuration, the antenna device can receive both of the radio waves of the first frequency arriving from the horizontal direction and the radio waves of the second frequency arriving from the zenith direction.

Because the radio waves of the first frequency and the radio waves of the second frequency can be received by one antenna element (that is, conductor pattern), two types of antenna elements as disclosed in Patent Literature 1 are not required. Therefore, the cost required for manufacturing the antenna device can be reduced. Further, the antenna device requires no monopole antenna for receiving the radio waves from the horizontal direction. Therefore, the mounting height of the antenna device can be suppressed.

In other words, according to the above configuration, the antenna device capable of receiving the radio waves from the zenith direction and the horizontal direction can suppress the mounting height and the costs.

DESCRIPTION OF EMBODIMENTS

Figure 1:
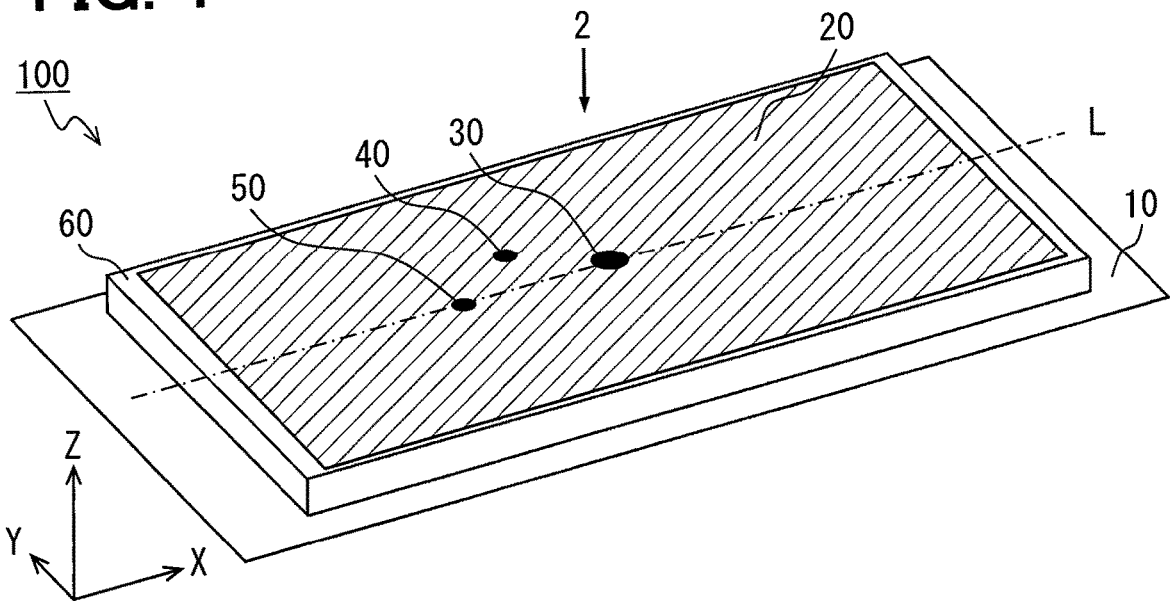
FIG. 1 is a perspective view illustrating a schematic configuration of an antenna device.
Figure 2:
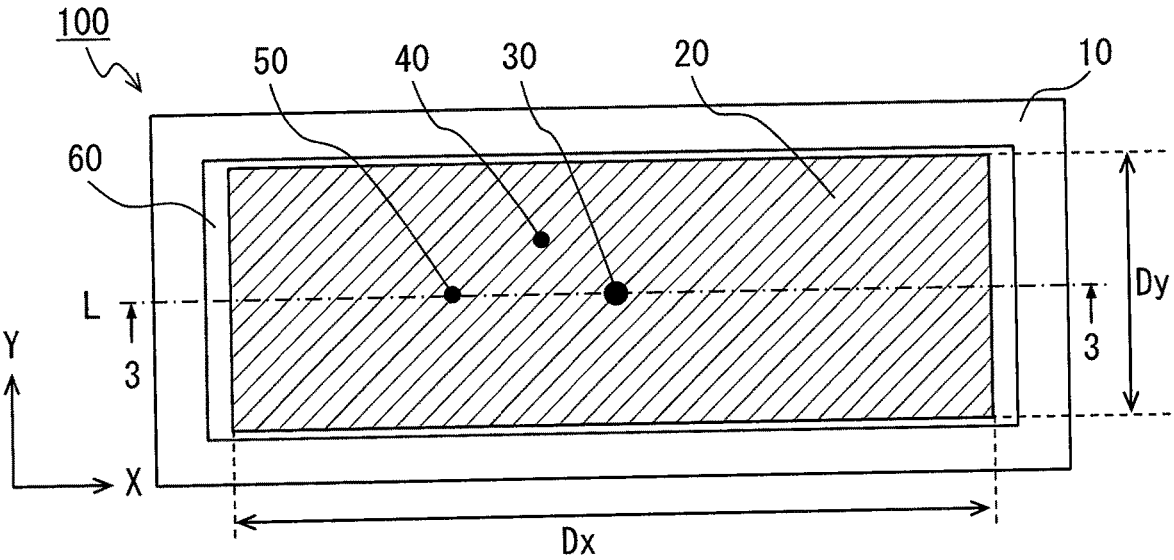
FIG. 2 is a top view of the antenna device.

Hereinafter, embodiments of the present disclosure will be described with reference to the accompanying drawings. FIG. 1 is a perspective view illustrating an example of a schematic configuration of an antenna device 100 according to the present embodiment. A top view of the antenna device 100 viewed from the direction of an arrow 2 in FIG. 1 is illustrated in FIG. 2.

The antenna device 100 is used, for example, in a vehicle, and transmits and receives radio waves of two different frequencies. Because the operation during transmission and the operation during reception have a symmetry, a case of receiving the radio waves will be described.

In more detail, the antenna device 100 receives both of radio waves transmitted from an equipment placed on earth at a first frequency and radio waves transmitted from a satellite at a second frequency. The radio waves transmitted from the satellite arrive from a zenith direction of the antenna device 100, and the radio waves transmitted from the equipment placed on earth arrive from a horizontal direction. In other words, the antenna device 100 receives the radio waves of the first frequency arriving from the horizontal direction and receives the radio waves of the second frequency arriving from the zenith direction.

The satellite for transmitting the radio waves of the second frequency corresponds to a GPS satellite used in, for example, a GPS (global positioning system). It is assumed that the second frequency is 1.6 GHz as a frequency of the same degree as that of the GPS radio waves. In addition, it is assumed that the first frequency is, for example, 700 MHz. The radio waves of a 700 MHz band are used in, for example, cellular phones and intervehicle communication systems.

In addition, the antenna device 100 is connected to a wireless device through, for example, coaxial cables (all omitted from the illustration), and signals received by the antenna device 100 are sequentially output to the wireless device. The wireless device uses the signals received by the antenna device 100 and supplies a high-frequency power corresponding to a transmission signal to the antenna device 100. Incidentally, in the present embodiment, it is assumed that the coaxial cables are employed as feeding lines to the antenna device 100, but another known feeding line such as a feeder line may be used.

The antenna device 100 and the wireless device may be connected to each other through two respective coaxial cables corresponding to the first frequency and the second frequency, or may be connected through one coaxial cable. In the present embodiment, as an example, the antenna device 100 and the wireless device are connected to each other through two coaxial cables including a coaxial cable for transmitting and receiving the signal of the first frequency and a coaxial cable for transmitting and receiving the signal of the second frequency. Incidentally, as another configuration, when the antenna device 100 and the wireless device are connected to each other through one coaxial cable, a switch circuit for switching the frequency of the signal to be transmitted or received may be used.

Hereinafter, a specific configuration and operation of the antenna device 100 will be described.

A illustrated in FIG. 1, the antenna device 100 includes a ground plate 10, a conductor pattern 20, a short-circuit portion 30, a first feeding point 40, a second feeding point 50, and a support member 60.

The ground plate 10 is configured by a rectangular plate (including a foil) made of a conductor such as copper. The ground plate 10 is electrically connected to an external conductor of the coaxial cable and provides a ground potential (ground potential) in the antenna device 100. The shape of the ground plate 10 is not limited to a rectangular shape if the ground plate 10 is larger than the conductor pattern 20.

The support member 60 is configured by a plate-shaped member having a predetermined thickness h, which is made of an electric insulating material such as resin. The support member 60 is disposed so that flat portions of the ground plate 10 and the plate-shaped conductor pattern 20 face each other at a predetermined distance h. Therefore, a shape of the support member 60 is not limited to the plate shape. The support member 60 may be configured by multiple pillars that support the ground plate 10 and the conductor pattern 20 to be described later to face each other at the predetermined distance h.

In addition, in the present embodiment, a space between the ground plate 10 and the conductor pattern 20 is filled with a resin (that is, the support member 60), but the present disclosure is not limited to this configuration. The space between the ground plate 10 and the conductor pattern 20 may be hollow (or vacuum), or may be filled with a dielectric having a predetermined inductive rate. Further, structures illustrated above may be combined together.

The conductor pattern 20 is configured by a rectangular plate (including a foil) made of a conductor such as copper. The conductor pattern 20 faces the ground plate 10 through the support member 60 in parallel (including a substantially parallel due to a dimensional variation). Incidentally, in this example, the shape of the conductor pattern 20 has a rectangle having long sides and short sides, but another shape of the conductor pattern 20 may be square or a shape other than the rectangle or the square. Modifications of the shape of the conductor pattern 20 will be described later.

As well known, the rectangle includes the combinations of two sides (opposite sides) facing each other, and each combination of the opposite sides has an axisymmetric shape with respect to a line segment connecting midpoints of the opposite sides as an axis of symmetry. In addition, the line segment connecting the midpoints of the opposite sides of one combination is orthogonal to a line segment connecting the midpoints of the opposite sides of the other combination. In other words, the rectangle is a shape that is axisymmetrical with respect to one straight line as the axis of symmetry, and axisymmetrical with respect to another straight line orthogonal to the one straight line as the axis of symmetry.

Hereinafter, the configuration of the antenna device 100 will be described with the appropriate introduction of a concept of a three-dimensional coordinate system in which a long-side direction of the conductor pattern 20 is taken as an X-axis and a short-side direction is taken as a Y-axis, and a direction that is orthogonal to the X-axis and the Y-axis and heads from the ground plate 10 toward the conductor pattern 20 is taken as a Z-axis. As an example, the X-axis direction corresponds to a second direction of the present disclosure, and the Y-axis direction corresponds to a first direction of the present disclosure.

A length Dx of the sides of the conductor pattern 20 in the X-axis direction is a value corresponding to a length of half a wavelength (second wavelength) of the radio waves at the second frequency. The value corresponding to the length of half the second wavelength represents a value that is an electric length of half the second wavelength, which is a value determined taking an influence of a fringing electric field and so on into consideration. In general, the electric length is also called "effective length".

Incidentally, when the space between the conductor pattern 20 and the ground plate 10 is filled with a dielectric having a predetermined inductive rate, the length Dx of the sides in the X-axis direction may be set to an electric length corresponding to a length of half the second wavelength, taking the influence of the inductive rate into consideration. In other words, the length Dx of the sides of the conductor pattern 20 in the X-axis direction is a value determined on the basis of the length of half the second wavelength.

An area of the conductor pattern 20 forms a capacitance that resonates in parallel with an inductance component provided in the short-circuit portion 30 to be described later, at the first frequency. Therefore, a length Dy of the sides of the rectangular conductor pattern 20 in the Y-axis direction is a value obtained by dividing the area by the X-axis direction length Dx. In other words, a shape of the conductor pattern 20 may be appropriately designed on the basis of an inductance component provided in the short-circuit portion 30, the first frequency, and the second frequency.

Figure 3:
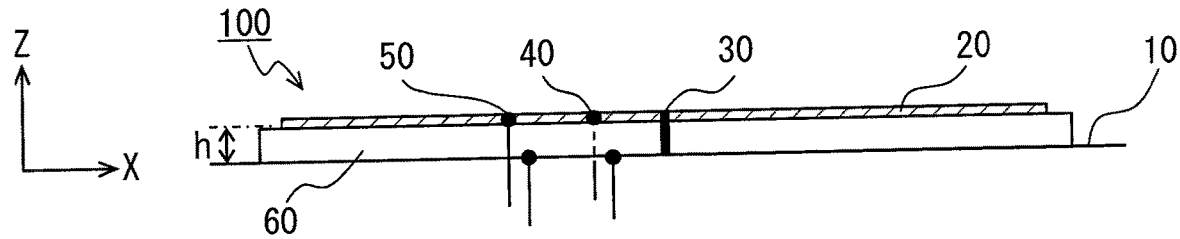
FIG. 3 is a cross-sectional view of the antenna device.

As illustrated in FIG. 3, the short-circuit portion 30 is a portion where the conductor pattern 20 and the ground plate 10 are electrically connected to each other, which is disposed in the center portion of the conductor pattern 20. The center portion is set to an intersection of diagonals of the conductor pattern 20. FIG. 3 is a diagram of a cross-section of the antenna device 100 along a line L that passes through the short-circuit portion 30 and is in parallel to the X-axis direction when viewed from a direction of an arrow 3. The short-circuit portion 30 may be realized by a conductive pin (called "short pin"). The inductance provided in the short-circuit portion 30 can be adjusted according to a thickness of the short pin.

Each of the first feeding point 40 and the second feeding point 50 is a portion in which an internal conductor of the coaxial cable is electrically connected to the conductor pattern 20. The second feeding point 50 is disposed on the line L passing through the short-circuit portion 30 in the X-axis direction, and a distance between the second feeding point 50 and the short-circuit portion 30 may be set so that a characteristic impedance of the coaxial cable matches an impedance of the antenna device 100 at the second frequency.

Similarly, a distance between the first feeding point 40 and the short-circuit portion 30 may be set so as to match the impedances between the coaxial cable and the antenna device 100 at the first frequency. In an area satisfying the condition, any installation position of the first feeding point 40 may be acceptable. Therefore, as in a modification 6 to be described later, the first feeding point 40 may match the second feeding point.

The wireless device supplies an electric power energy from the first feeding point 40 or the second feeding point 50 to the antenna device 100, to thereby transmit signals at a desired frequency and receive the radio waves of a desired frequency. In the present embodiment, each of those feeding points 40 and 50 is connected directly to the coaxial cable, but is not limited to this configuration. Each of the feeding points 40 and 50 may be connected to the coaxial cable through a known matching circuit.

Subsequently, the operation of the antenna device 100 will be described. The antenna device 100 has two operation modes including a mode (referred to as a "first frequency mode") for receiving the radio waves of the first frequency and a mode (referred to as a "second frequency mode") for receiving the radio waves of the second frequency.

For convenience, the second frequency mode will be first described. The second frequency mode is an operation mode applying a configuration of a known patch antenna. A main difference between the general patch antenna and the configuration of the present embodiment resides in that the short-circuit portion 30 is disposed in the center portion of the conductor pattern 20 in the X-axis direction. In other words, a configuration having no short-circuit portion 30 can be considered to perform the same operation as that of the known patch antenna.

Figure 4:
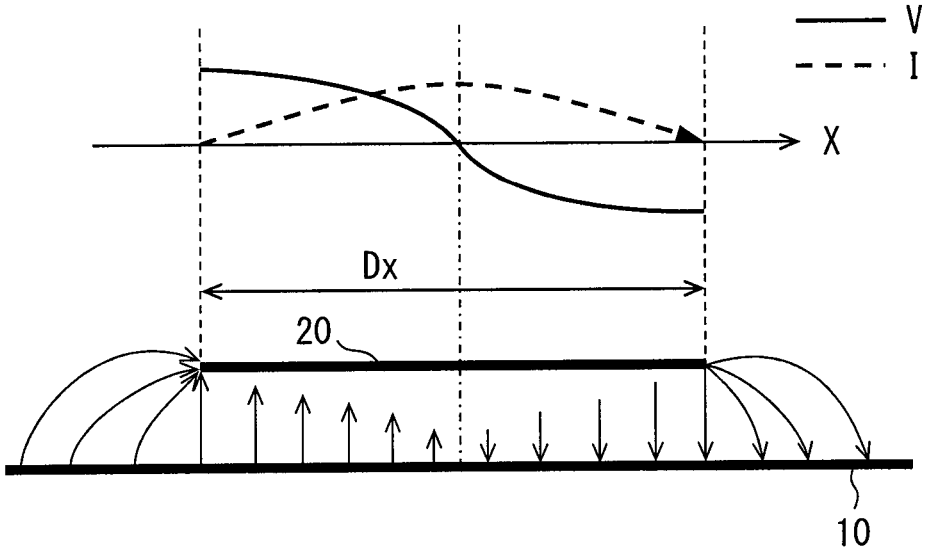
FIG. 4 is a conceptual diagram illustrating the distributions of a current, a voltage, and an electric field when transmitting and receiving radio waves of a second frequency.

In general, it is known that in the rectangular patch antenna, the current and voltage are distributed in a direction of the sides, the electric length of which is a half wavelength of the target radio waves, as illustrated in FIG. 4. The wavelength of the target radio waves corresponds to the second wavelength in this example, and the direction of the sides, the electric length of which is the half wavelength of the target radio waves corresponds to the X-axis direction in the present embodiment.

The distributions of the current and the voltage of the general patch antenna will be described in association with the configuration of the present embodiment. A current standing wave, an amplitude of which is zero on both end portions of the conductor pattern 20 and maximum in the center portion of the conductor pattern 20 is generated. In addition, since the phases of the current standing wave and the voltage standing wave are different from each other by a quarter wavelength, the amplitude of the voltage standing wave becomes maximum on both end portions of the conductor pattern in the X-axis direction and zero in the center portion of the conductor pattern. Further, since an electric field intensity generated between the conductor pattern and the ground plate is in proportion to the amplitude of the voltage excited on the conductor pattern, the amplitude becomes maximum on both end portions of the conductor pattern in the X-axis direction and zero in the center portion. Incidentally, the fringing electric field is generated on both end portions of the conductor pattern.

In this example, in the general patch antenna, the electric field intensity in the center portion in the X-axis direction becomes zero. For that reason, even if the short-circuit portion 30 is provided in the center portion of the conductor pattern 20 as in the present embodiment, the current standing wave and the voltage standing wave formed on the conductor pattern 20, and the voltage distribution are not affected by the short-circuit portion 30. In other words, even if the short-circuit portion 30 is provided as in the present embodiment, the same radiation characteristic as that of the known patch antenna is obtained.

Figure 5:
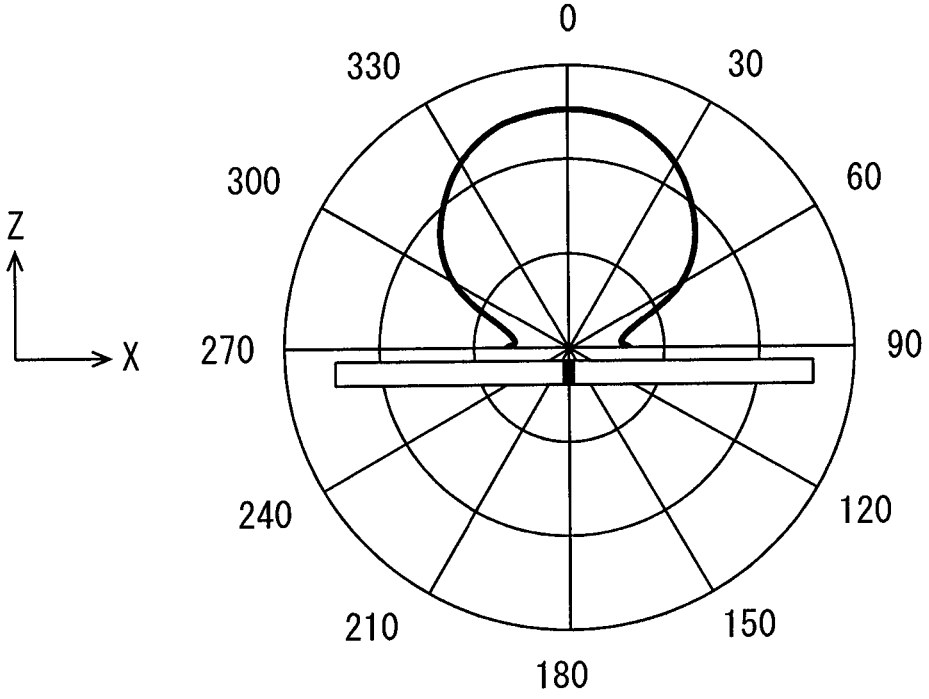
FIG. 5 is a diagram illustrating a directivity of the antenna device for radio waves of a second frequency.

With the above configuration, in the second operation mode, the directivity is provided in the Z-axis direction (zenith direction) as illustrated in FIG. 5, and the radio waves of the second frequency arriving from the zenith direction can be efficiently received. In addition, because the antenna device 100 has the reversibility of transmission and reception, the antenna device 100 radiates the radio waves of the second frequency in the zenith direction at the time of transmission.

Incidentally, the current (or voltage) excited on the conductor pattern 20 by the radio waves of the second frequency flows from the second feeding point 50 performing the impedances matching to the coaxial cable connected to the second feeding point 50. In other words, the signal in the second frequency mode is transmitted to the wireless device through the second feeding point 50.

Next, the first frequency mode will be described. The first frequency mode is an operation mode applying the configuration of a known planar inverted-F antenna. The area of the conductor pattern 20 forms the capacitance that resonates in parallel to the inductance component provided in the short-circuit portion 30 at the first frequency. In addition, the conductor pattern 20 is short-circuited to the ground plate 10 by the short-circuit portion 30 disposed in the center portion of the conductor pattern 20.

Figure 6:
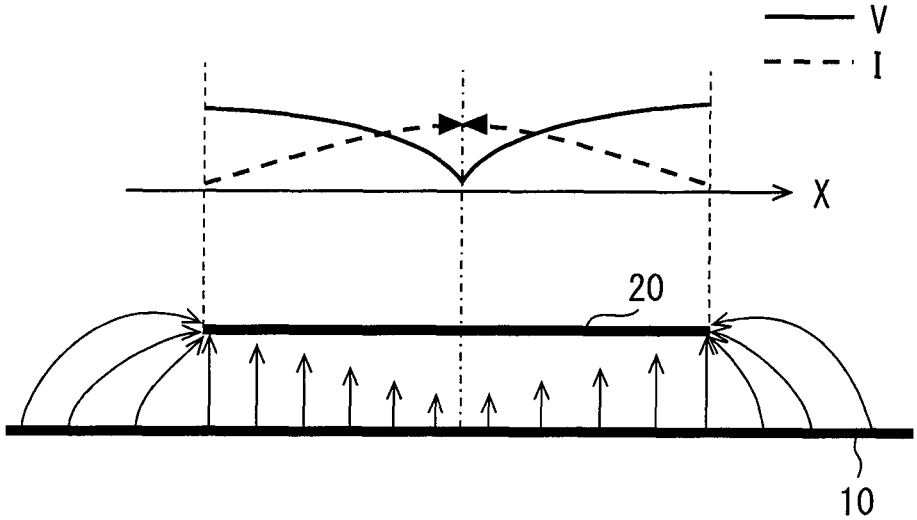
FIG. 6 is a conceptual diagram illustrating the distributions of the current, the voltage, and the electric field when transmitting and receiving radio waves of a first frequency.

For that reason, in the first frequency mode, as illustrated in FIG. 6, the voltage standing wave, the amplitude of which is maximum on both end portions of the conductor pattern 20 and zero in the vicinity of the center portion of the conductor pattern 20, is generated in the conductor pattern 20. Incidentally, a sign of the voltage standing wave is positive in both of those regions. The electric field intensity generated between the conductor pattern 20 and the ground plate 10 is maximum on both end portions of the conductor pattern 20 and zero in the vicinity of the center portion of the conductor pattern 20.

The amplitude of the current standing wave becomes maximum in the center portion of the conductor pattern 20 and zero on both end portions of the conductor pattern 20, and the current on each portion is headed toward the center portion of the conductor pattern 20. The direction of current generated in each portion of the conductor pattern 20 is headed from the end portions toward the center portion in which the short-circuit portion 30 is provided.

Incidentally, FIG. 6 illustrates the distributions of the electric field, the current, and the voltage in the X-axis direction, and the same distribution as that in FIG. 6 is shown in a plane (XY-plane) passing the X-axis and the Y-axis. In other words, the amplitude of the voltage and the electric field intensity are increased more toward the end portions of the conductor pattern 20 from the center portion of the conductor pattern 20 whereas the magnitude of the current is increased more from the end portions toward the center portion.

Figure 7:
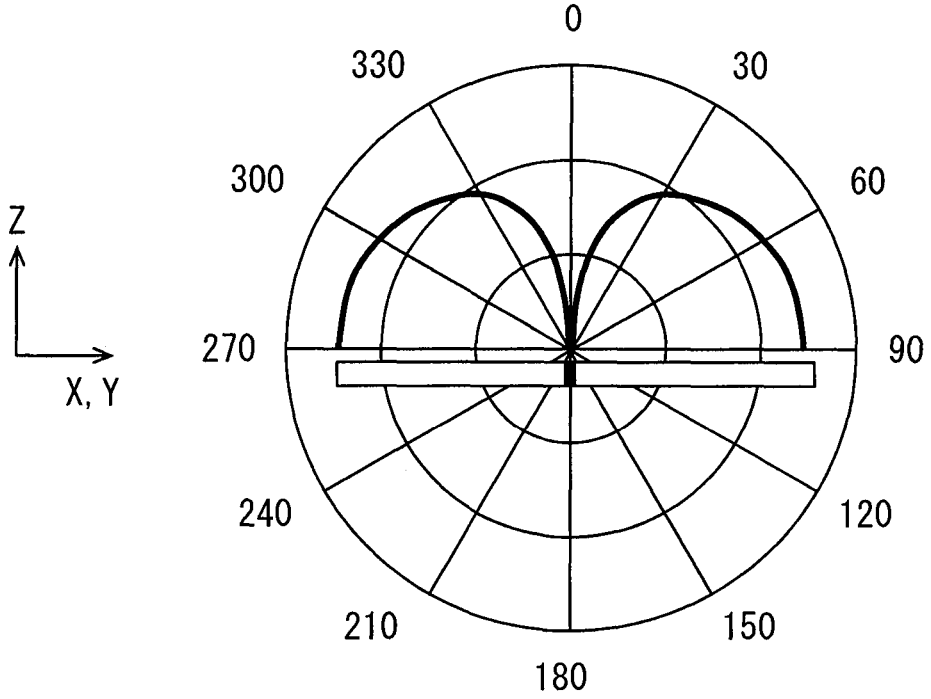
FIG. 7 is a diagram illustrating a directivity of the antenna device for radio waves of the first frequency.

In the first frequency mode, because the electric field, the current, and the voltage are distributed as illustrated in FIG. 6, the directivity is provided in the horizontal direction, and the electric wave of the first frequency arriving from the horizontal direction can be efficiently received as illustrated in FIG. 7. Incidentally, when the antenna device 100 is placed on a horizontal plane (including a substantially horizontal plane due to a dimensional variation), a direction parallel to the XY-plane corresponds to the horizontal direction.

The current (or voltage) excited on the conductor pattern 20 by the radio waves of the first frequency flows from the first feeding point 40 performing the impedance matching into the coaxial cable. In other words, the signal in the first frequency mode is transmitted to the wireless device through the first feeding point 40. The same is applied to the first mode at the time of transmitting the signal.

Conclusion of the Embodiment

According to the above configuration, the antenna device operates as the first frequency mode for the radio waves of the first frequency arriving from the horizontal direction, and can receive the signal corresponding to the radio waves. In addition, the antenna device operates as the second frequency mode for the radio waves of the second frequency arriving from the zenith direction, and receives the signal corresponding to the radio waves.

The first frequency mode and the second frequency mode can be realized by one antenna element (that is, the conductor pattern 20). In other words, the two types of antenna elements as disclosed in Patent Literature 1 are not required. Therefore, the cost required for manufacturing the antenna device 100 can be reduced.

Further, the antenna device 100 can receive the radio waves from the horizontal direction by the conductor pattern 20, and no monopole antenna is required to receive the radio waves from the horizontal direction. Therefore, a height of the antenna device 100 can be suppressed, and the mountability on the vehicle can be improved.

Furthermore, the frequency of the radio waves to be received in the second frequency mode is determined according to the electric length of the sides in the X-axis direction, and the frequency of the radio waves to be received in the first frequency mode is determined according to the inductance of the short-circuit portion 30 and the area of the conductor pattern 20. In other words, according to the configuration of the present embodiment, the frequency of the radio waves from the zenith direction and the frequency of the radio waves from the horizontal direction can be arbitrarily set.

Incidentally, in the present embodiment, among the sides provided in the rectangular conductor pattern 20, the sides (sides in the X-axis direction) having the electric length that is half the second wavelength are relatively long sides, but the present disclosure is not limited to the above configuration. The sides in the X-axis direction may be relatively short sides.

Figure 8:
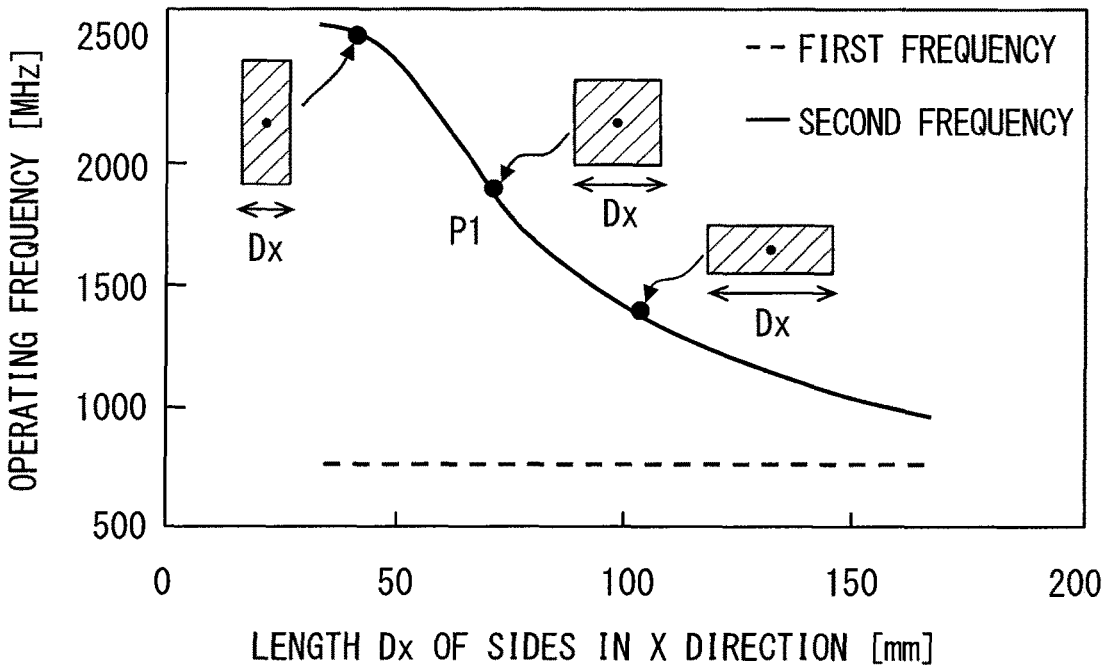
FIG. 8 is a diagram illustrating a relationship between the second frequency and a conductor pattern.

FIG. 8 is a diagram illustrating a relationship between the second frequency, the length of the sides in the X-axis direction, and the shape of the conductor pattern 20 when the first frequency is kept constant (for example, 700 MHz). In the graph illustrated in FIG. 8, the axis of ordinate indicates the frequency, and the axis of abscissa indicates the length of the sides in the X-axis direction. In the graph, a broken line represents the values of the first frequency, and a solid line represents the second frequency.

In FIG. 8, a point P1 indicates the second frequency (as an example, 1900 MHz) when the shape of the conductor pattern 20 is square. In general, because the wavelength is shorter as the frequency is higher, when the second frequency is higher than 1900 MHz, the conductor pattern 20 is formed into a rectangle in which the sides in the X-axis direction are the short sides. On the other hand, when the second frequency is lower than 1900 MHz, the conductor pattern 20 is formed into a rectangle in which the sides in the X-axis direction are the long sides. The second frequency when the shape of the conductor pattern 20 is square is changed according to the first frequency, the inductance of the short-circuit portion 30, and the inductive rate between the conductor pattern 20 and the ground plate 10.

The embodiments of the present disclosure have been described above. However, the present disclosure is not limited to the above-described embodiments, and various modifications described below also fall within the technical scope of the present disclosure. Further, the present disclosure can be implemented with various changes without departing from the spirit of the present disclosure, aside from the following modifications.

Figure 9:
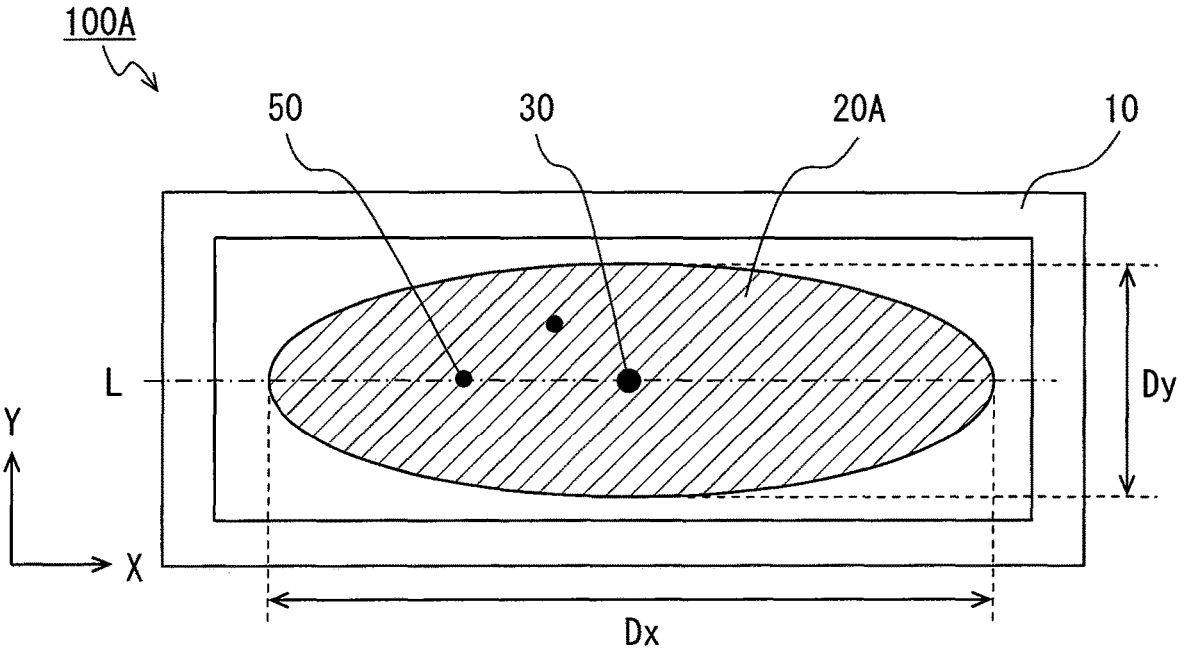
FIG. 9 is a top view illustrating a schematic configuration of an antenna device according to a modification 1.

For example, in the embodiment described above, the shape of the conductor pattern 20 is rectangular, but the present disclosure is not limited to the above shape. As illustrated in FIG. 9, a conductor pattern 20A provided in an antenna device 100A may be ellipse (Modification 1). The ellipse is also an axisymmetric shape with respect to each of a long axis and a short axis orthogonal to each other as the axes of symmetry. FIG. 9 illustrates an example in which the long axis is an electric length of half the second wavelength.

Figure 10:
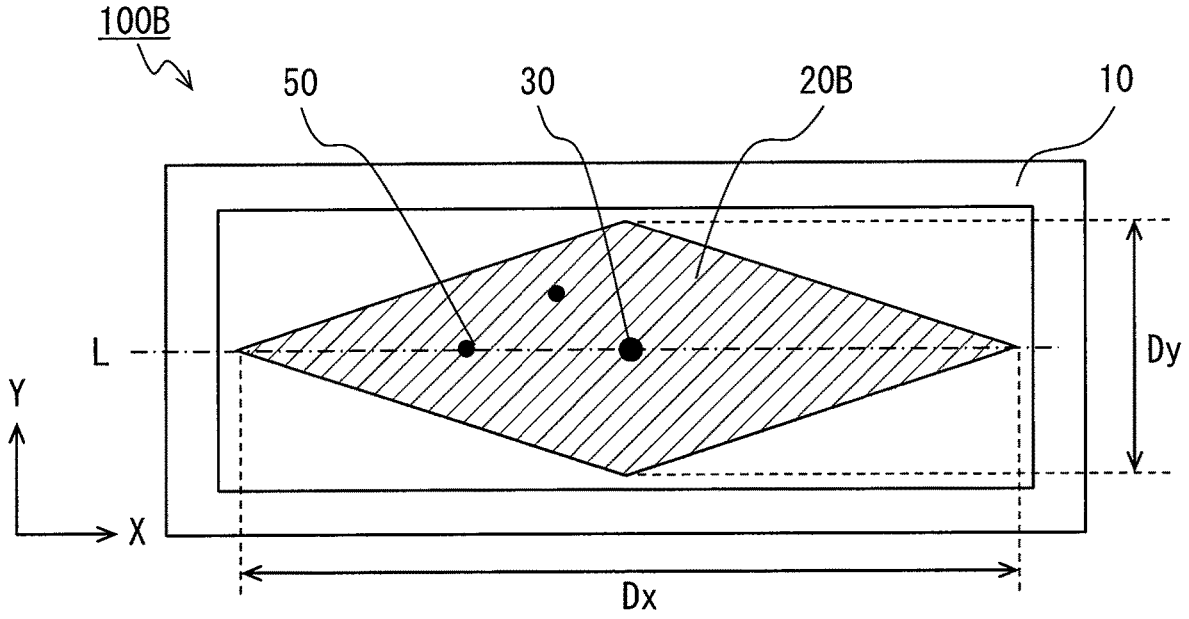
FIG. 10 is a top view illustrating a schematic configuration of an antenna device according to a modification 2.

In addition, as illustrated in FIG. 10, a conductor pattern 20B provided in an antenna device 100B may be diamond (Modification 2). The diamond is also a shape axisymmetric with respect to each of diagonals orthogonal to each other as the axes of symmetry. Incidentally, FIG. 10 illustrates an example in which one of the diagonals (diagonal in the X-axis direction) is an electric length of half the second wavelength.

Figure 11:
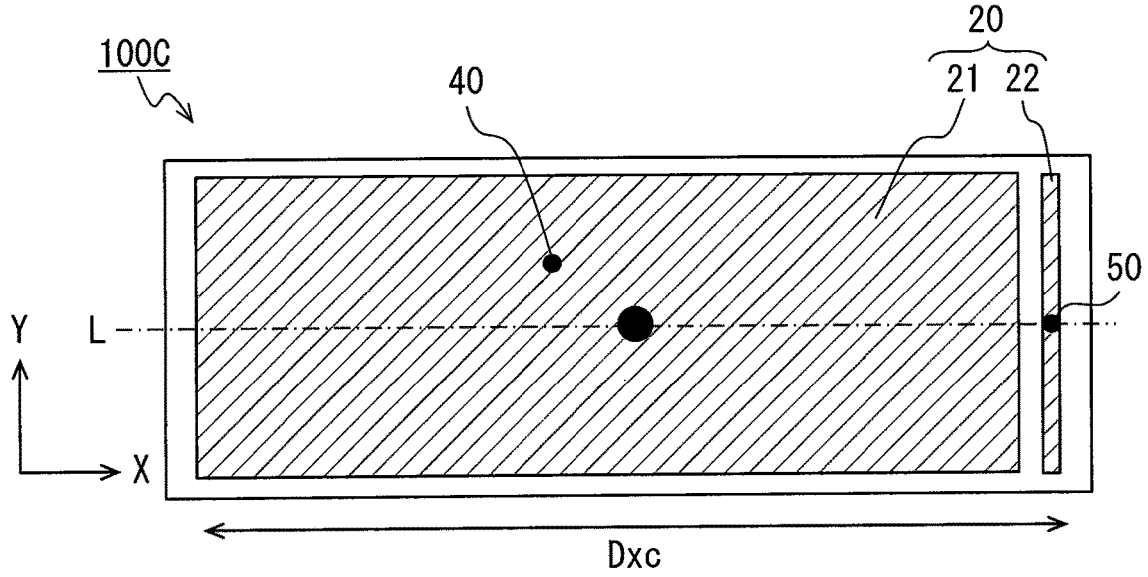
FIG. 11 is a top view illustrating a schematic configuration of an antenna device according to a modification 3.

Further, the conductor pattern 20 may be realized by multiple parts disposed at predetermined distances from each other. For example, as illustrated in FIG. 11, the conductor pattern 20 may include a rectangular primary conductor portion 21 having long sides in the X-axis direction and a rectangular secondary conductor portion 22 having long sides in the Y-axis direction (Modification 3). In an antenna device 100C illustrated in FIG. 11, the length of the secondary conductor portion 22 in the Y-axis direction is equal to the length of the primary conductor portion 21 in the Y-axis direction, and the primary conductor portion 21 and the secondary conductor portion 22 are disposed on the support member 60 so as to be in parallel to the Y-axis direction at a predetermined distance in the X-axis direction. The width of the secondary conductor portion 22 in the X-axis direction may be set to be remarkably smaller than that in the Y-axis direction (that is, linear shape). In the antenna device 100C, the first feeding point 40 is disposed on the primary conductor portion 21, and the second feeding point 50 is disposed on the secondary conductor portion 22.

The primary conductor portion 21 and the secondary conductor portion 22 are disposed in parallel to each other at a predetermined distance, as a result of which a capacitance component is formed between the primary conductor portion 21 and the secondary conductor portion 22, and the capacitance component corresponds to a magnitude of a gap provided between the primary conductor portion 21 and the secondary conductor portion 22. The capacitance component functions as a filter. In other words, a frequency component corresponding to the magnitude of the capacitance caused by the gap between the primary conductor portion 21 and the secondary conductor portion 22 in the current excited on the conductor pattern 20 flows into the secondary conductor portion 22.

In this example, a size of the gap between the primary conductor portion 21 and the secondary conductor portion 22 is set to a size allowing a current corresponding to the signal of the second frequency to flow into the secondary conductor portion 22, thereby being capable of setting the signal transmitted from the second feeding point 50 disposed on the secondary conductor portion 22 to the wireless device as the signal of the second frequency.

In other words, the first feeding point 40 and the second feeding point 50 are provided on parts physically separated from each other, as a result of which the frequency component of the current flowing into the coaxial cable from the first feeding point 40 and the frequency component of the current flowing into the coaxial cable from the second feeding point 50 can be set to currents of respective desired frequencies. For example, the capacitance provided between the secondary conductor portion 22 and the primary conductor portion 21 may have a magnitude that allows the signal of the second frequency to pass through the capacitance and the signal of the first frequency to be cut off and attenuated. Incidentally, a length Dxc of the X-axis direction necessary to perform a series resonance by the signal of the second frequency may be set to an electric length of half the second wavelength as in the present embodiment, and may be determined on the basis of the capacitance generated in the gap between the primary conductor portion 21 and the secondary conductor portion 22.

Figure 12:
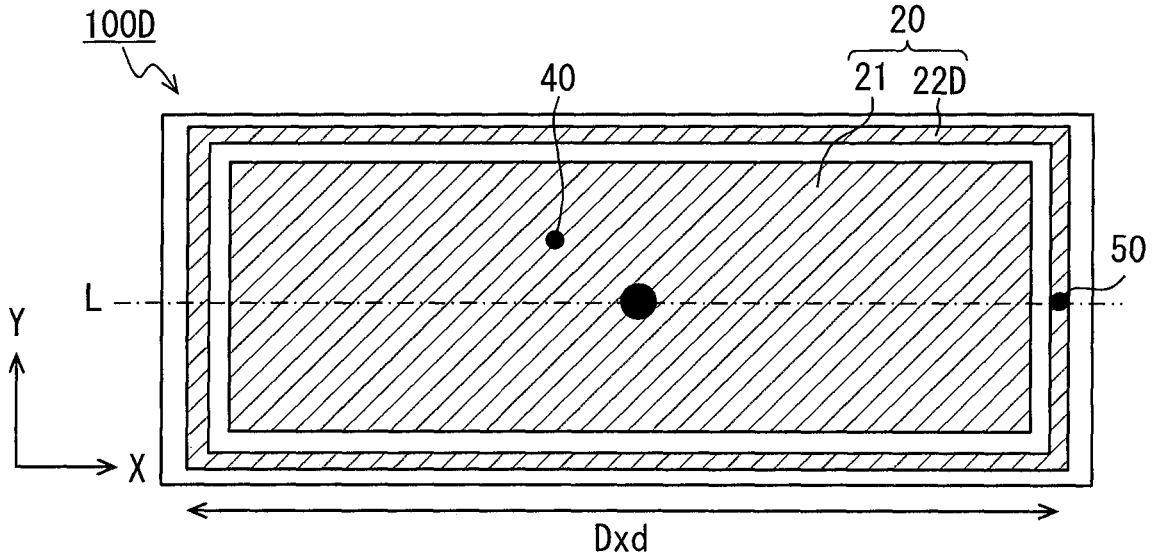
FIG. 12 is a top view illustrating a schematic configuration of an antenna device according to a modification 4.

In addition, as illustrated in FIG. 12, the secondary conductor portion 22 provided with the second feeding point 50 may be shaped into a frame that surrounds the primary conductor portion 21 at a predetermined distance (Modification 4). In other words, the conductor pattern 20 of an antenna device 100D according to Modification 4 includes the rectangular primary conductor portion 21 and a frame-shaped secondary conductor portion 22D.

As illustrated in FIG. 4, the secondary conductor portion 22D is formed into the shape that surrounds the four sides of the primary conductor portion 21 at the predetermined distance with the result that the capacitance provided between the primary conductor portion 21 and the secondary conductor portion 22D can be set to be larger than that of the secondary conductor portion 22 in Modification 3.

A length Dxd in the X-axis direction according to Modification 4 may have the electric length of half the second wavelength and may be determined on the basis of the capacitance caused in the gap between the primary conductor portion 21 and the secondary conductor portion 22D. The shape of the conductor pattern 20 illustrated in FIGS. 11 and 12 can be considered as a shape obtained by cutting out a part of a rectangular conductor plate so as to provide the gap forming a predetermined capacitance. In other words, the planar shapes of the conductor pattern 20 illustrated in FIGS. 11 and 12 are shapes based on a rectangular that is a shape axisymmetric with respect to the long sides and the short sides orthogonal to each other as the axes of symmetry. As described above, the shape based on the axisymmetric shape can include a shape having the shape axisymmetric with respect to two directions orthogonal to each other, and the secondary shape located at the predetermined distance from the axisymmetric shape.

Figure 13:
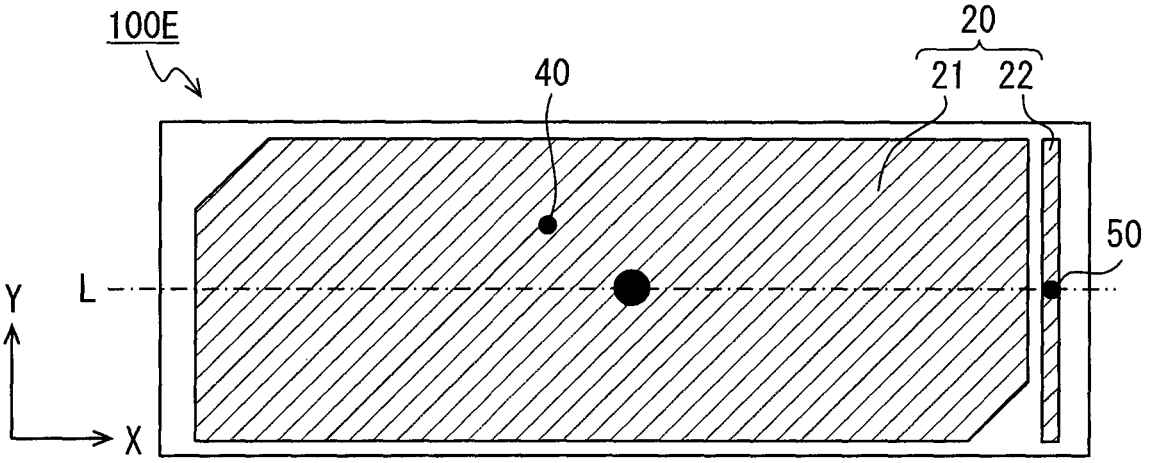
FIG. 13 is a top view illustrating a schematic configuration of an antenna device according to a modification 5.

Further, as illustrated in FIG. 13, the conductor pattern 20 in Modification 3 may be formed into a shape obtained by parts of a pair of diagonals of the primary conductor portion 21 by a predetermined area (Modification 5). In other words, the planar shape of the conductor pattern 20 according to Modification 5 is also a shape based on a rectangle that is a shape axisymmetric with respect to the long sides and the short sides orthogonal to each other as the axes of symmetry. As described above, the shape based on the axisymmetric shape can include a shape in which a predetermined area is removed from the shape axisymmetric with respect to the two directions orthogonal to each other. With the above configuration, an antenna device 100E can excite a circularly polarized wave at the second frequency. Incidentally, a method of exciting the circularly polarized wave by cutting out parts of a pair of diagonals of the rectangular conductor has been known as a shrinkage separation method.

In addition, when there is a point (compatible point) at which the impedance matching for the coaxial cable can be performed at both of the first frequency and the second frequency, the feeding point may be provided at the compatible point. In that case, an antenna device 100F is configured to provide only one feeding point. Such a configuration is illustrated in Modification 6, and the antenna device 100F in Modification 6 is illustrated in FIG. 14.

Figure 14:
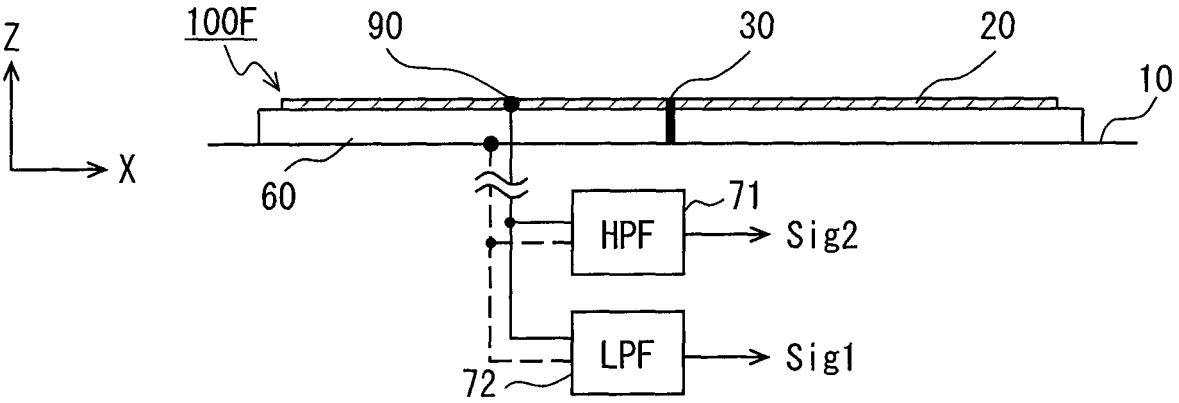
FIG. 14 is a top view illustrating a schematic configuration of an antenna device according to a modification 6.

FIG. 14 is a cross-sectional view corresponding to FIG. 3 illustrating the above-mentioned embodiment, which is taken along the short-circuit portion 30 of the antenna device 100F. A feeding point 90 illustrated in FIG. 14 serves as both of the first feeding point 40 and the second feeding point 50 in the above-mentioned embodiment, and is disposed on a straight line L. Because the feeding point 90 functions as the compatible point, the current flowing to the external of the conductor pattern 20 from the feeding point 90 may include both of the first frequency component and the second frequency component.

A high-pass filter 71 and a low-pass filter 72 provided in the antenna device 100F are configured to extract the first frequency component and the second frequency component from the current flowing from the feeding point 90 to the external of the conductor pattern 20, respectively. In more detail, the high-pass filter 71 cuts off (attenuates) the first frequency component and allows a signal Sig2 of the second frequency component to pass through the high-pass filter 71. The low-pass filter 72 cuts off the second frequency component and allows a signal Sig1 of the first frequency component to pass through the low-pass filter 72. The high-pass filter 71 and the low-pass filter 72 may be realized by a known filter circuit. The high-pass filter 71 corresponds to a second frequency filter according to the present disclosure, and the low-pass filter 72 corresponds to a first frequency filter according to the present disclosure.

The current excited on the conductor pattern 20 is output to both of the high-pass filter 71 and the low-pass filter 72 from the feeding point 90. If the radio waves that are currently being received are of the first frequency, the signal Sig1 of the first frequency derived from the received radio waves is transmitted to the wireless device through the low-pass filter 72. If the radio waves that are currently being received are of the second frequency, the signal Sig2 of the second frequency derived from the received radio waves is transmitted to the wireless device through the high-pass filter 71. In other words, the feeding point 90 is connected to the wireless device disposed externally through the low-pass filter 72 and the high-pass filter 71.

According to the above configuration, the number of feeding points provided in the antenna device can be reduced more than that in the embodiment described above.

What is claimed is:

1. An antenna device comprising:

a ground plate;

a plate-shaped conductor pattern disposed to face the ground plate at a predetermined distance from the ground plate;

a short-circuit portion that electrically connects the conductor pattern to the ground plate; and at least one feeding point that electrically connects the conductor pattern to a feeding line for feeding a power to the conductor pattern, wherein a planar shape of the conductor pattern is an axisymmetrical shape or is based on the axisymmetrical shape, the axisymmetrical shape being symmetrical about a symmetrical axis that is a straight line parallel to a first direction and a second direction, the second direction being orthogonal to the first direction, the short-circuit portion is disposed in a center portion of the conductor pattern, an area of the conductor pattern forms a capacitance that resonates in parallel with an inductance included in the short-circuit portion at a first frequency such that vertically polarized waves at the first frequency radiate along a direction from the center portion to edge portions of the conductor pattern, an entire physical length of the conductor pattern in the second direction has an electric length in the second direction that is half of a wavelength of radio waves at a second frequency such that radio waves at the second frequency radiate along a direction from the ground plate to the conductor pattern, the second frequency being different from the first frequency, the at least one feeding point is configured to transmit and receive a signal at the first frequency and a signal at the second frequency, and a uniform, continuous area of the conductor pattern forms the capacitance that resonates in parallel with the inductance included in the short-circuit portion at the first frequency.

2. The antenna device according to claim 1, wherein the planar shape of the conductor pattern is any one of a rectangle, a diamond, and an ellipse, or a shape based on the rectangle, the diamond, or the ellipse.

3. The antenna device according to claim 2, wherein the antenna device includes, as the feeding point, a first feeding point for transmitting and receiving the signal at the first frequency and a second feeding point for transmitting and receiving the signal at the second frequency, the shape of the conductor pattern is a rectangle having a pair of opposite sides parallel to the first direction and a pair of opposite sides parallel to the second direction, an electric length of the sides of the conductor pattern in the second direction is half the wavelength of the second frequency, and the second feeding point is disposed on a straight line that passes the center portion and that is in parallel to the second direction.

4. The antenna device according to claim 3, wherein the conductor pattern includes a primary conductor portion having the center portion and a secondary conductor portion that is disposed at a predetermined distance on a plane on which the primary conductor portion is disposed, a capacitance formed between the secondary conductor portion and the primary conductor portion by a gap provided between the secondary conductor portion and the primary conductor portion has a magnitude that allows the signal of the second frequency to pass through the capacitance and the signal of the first frequency to be cut off or attenuated, and the first feeding point is disposed in the primary conductor portion and the second feeding point is disposed in the secondary conductor portion.

5. The antenna device according to claim 4, wherein the secondary conductor portion is disposed to surround the primary conductor portion at the predetermined distance.

6. The antenna device according to claim 1, wherein the feeding point is disposed at a position that matches a characteristic impedance of the feeding line at both of the first frequency and the second frequency, the feeding point is connected to a first frequency filter through which the signal of the first frequency passes and a second frequency filter through which the signal of the second frequency passes, and the feeding point is connected to an externally disposed wireless device disposed through each of the first frequency filter and the second frequency filter.

7. An antenna device comprising:

a ground plate;

a plate-shaped conductor pattern disposed to face the ground plate at a predetermined distance from the ground plate;

a short-circuit portion that electrically connects the conductor pattern to the ground plate; and at least one feeding point that electrically connects the conductor pattern to a feeding line for feeding a power to the conductor pattern, wherein a planar shape of the conductor pattern is an axisymmetrical shape or is based on the axisymmetrical shape, the axisymmetrical shape being symmetrical about a symmetrical axis that is a straight line parallel to a first direction and a second direction, the second direction being orthogonal to the first direction, the short-circuit portion is disposed in a center portion of the conductor pattern, an area of the conductor pattern forms a capacitance that resonates in parallel with an inductance included in the short-circuit portion at a first frequency, an electric length of the conductor pattern in the second direction is half of a wavelength of radio waves at a second frequency, the second frequency being different from the first frequency, the antenna device includes, as the feeding point, a first feeding point for transmitting and receiving a signal at the first frequency and a second feeding point for transmitting and receiving a signal at the second frequency, the shape of the conductor pattern is a rectangle having a pair of opposite sides parallel to the first direction and a pair of opposite sides parallel to the second direction, an electric length of the sides of the conductor pattern in the second direction is half the wavelength of the second frequency, and the second feeding point is disposed on a straight line that passes the center portion and that is in parallel to the second direction.

8. The antenna device according to claim 7, wherein the conductor pattern includes a primary conductor portion having the center portion and a secondary conductor portion that is disposed at a predetermined distance on a plane on which the primary conductor portion is disposed, a capacitance formed between the secondary conductor portion and the primary conductor portion by a gap provided between the secondary conductor portion and the primary conductor portion has a magnitude that allows the signal of the second frequency to pass through the capacitance and the signal of the first frequency to be cut off or attenuated, and the first feeding point is disposed in the primary conductor portion and the second feeding point is disposed in the secondary conductor portion.

9. The antenna device according to claim 8, wherein the secondary conductor portion is disposed to surround the primary conductor portion at the predetermined distance.

10. An antenna device comprising:

a ground plate;

a plate-shaped conductor pattern disposed to face the ground plate at a predetermined distance from the ground plate;

a short-circuit portion that electrically connects the conductor pattern to the ground plate; and at least one feeding point that electrically connects the conductor pattern to a feeding line for feeding a power to the conductor pattern, wherein a planar shape of the conductor pattern is an axisymmetrical shape or is based on the axisymmetrical shape, the axisymmetrical shape being symmetrical about a symmetrical axis that is a straight line parallel to a first direction and a second direction, the second direction being orthogonal to the first direction, the short-circuit portion is disposed in a center portion of the conductor pattern, an area of the conductor pattern forms a capacitance that resonates in parallel with an inductance included in the short-circuit portion at a first frequency, an electric length of the conductor pattern in the second direction is half of a wavelength of radio waves at a second frequency, the second frequency being different from the first frequency, the feeding point is disposed at a position that matches a characteristic impedance of the feeding line at both of the first frequency and the second frequency, the feeding point is connected to a first frequency filter through which the signal of the first frequency passes and a second frequency filter through which the signal of the second frequency passes, and the feeding point is connected to an externally disposed wireless device disposed through each of the first frequency filter and the second frequency filter.

11. The antenna device according to claim 1, wherein an entire area of the conductor pattern forms the capacitance that resonates in parallel with the inductance included in the short-circuit portion at the first frequency.

12. The antenna device according to claim 1, wherein the antenna device includes a first feeding point for transmitting and receiving the signal at the first frequency and a second feeding point for transmitting and receiving the signal at the second frequency, and the second feeding point and the short-circuit portion are disposed on a straight line that passes through the center portion of the conductor pattern, while the first feeding point is offset from the straight line.

* * * * *